US005994984A

United States Patent [19]

Stancil et al.

[11] Patent Number: 5,994,984

[45] **Date of Patent: *Nov. 30, 1999**

[54] WIRELESS SIGNAL DISTRIBUTION IN A BUILDING HVAC SYSTEM

[75] Inventors: Daniel D. Stancil, Mars, Pa.; Christopher P. Diehl, Centerville, Va.

[73] Assignee: Carnegie Mellon University, Pittsburgh, Pa.

[ * ] Notice: This patent is subject to a terminal disclaimer.

[21] Appl. No.: 09/087,784

[22] Filed: May 29, 1998

Related U.S. Application Data

[63] Continuation-in-part of application No. 08/969,399, Nov. 13, 1997.

[51] Int. Cl.[6] ..... H01P 5/12; H04H 1/10; H04H 1/14

[52] U.S. Cl. ..... 333/248; 455/3.1

[58] Field of Search ..... 333/239, 248; 455/3.1, 6.3

[56] References Cited

U.S. PATENT DOCUMENTS

| | | | |
|---|---|---|---|
| 4,688,007 | 8/1987 | Krill | 333/137 |
| 5,218,356 | 6/1993 | Knapp | 342/350 |
| 5,450,615 | 9/1995 | Fortune et al. | 455/67.6 |

FOREIGN PATENT DOCUMENTS

| | | |
|---|---|---|
| 0285295 | 10/1988 | European Pat. Off. . |
| 768505 | 8/1934 | France . |
| 2829302 | 1/1980 | Germany . |
| 56-047102 | 4/1981 | Japan . |
| 63-289439 | 11/1988 | Japan . |
| 06050592 | 2/1994 | Japan . |
| 07177066 | 7/1995 | Japan . |
| 07177068 | 7/1995 | Japan . |
| 07177070 | 7/1995 | Japan . |
| 08316918 | 11/1996 | Japan . |

OTHER PUBLICATIONS

Diehl et al., "Wireless RF Distribution in Buildings using Heating and Ventilation Ducts," 8th *Virginia Tech/MPRG Symposium on Wireless Personal Communications,* Jun. 1998.

*Primary Examiner*—Paul Gensler
*Attorney, Agent, or Firm*—Kirkpatrick & Lockhart LLP

[57] ABSTRACT

The present invention is directed to a system for using the ductwork of a building for transmitting electromagnetic radiation. The system includes a device for introducing electromagnetic radiation into the ductwork such that the ductwork acts as a waveguide for the electromagnetic radiation. The system also includes a bi-directional coupler positioned to re-radiate the electromagnetic radiation around an obstacle. The system further includes a device for enabling the electromagnetic radiation to propagate beyond the ductwork. The present invention is also directed to a method for transmitting electromagnetic radiation using the ductwork of a building and a method for designing a system for transmitting electromagnetic radiation in the ductwork of a building.

22 Claims, 5 Drawing Sheets

WIRELESS SIGNAL DISTRIBUTION IN A BUILDING HVAC SYSTEM

CROSS-REFERENCE TO RELATED APPLICATIONS

This application is a continuation-in-part of U.S. patent application Ser. No. 08/969,399, filed Nov. 13, 1997.

BACKGROUND OF THE INVENTION

1. Field of the Invention

The present invention is directed generally to wireless signal transmission, and, more particularly, to wireless signal transmission in a building heating, ventilation, and air conditioning (HVAC) system.

2. Description of the Background

Wireless transmission of electromagnetic radiation communication signals has become a popular method of transmitting RF signals such as cordless, wireless, and cellular telephone signals, pager signals, two-way radio signals, video conferencing signals, and local area network (LAN) signals indoors. Wireless transmission indoors has the advantage that the building in which transmission is taking place does not have to be fitted with wires and cables that are equipped to carry a multitude of signals. Wires and cables are costly to install and may require expensive upgrades when their capacity is exceeded or when new technologies require different types of wires or cables than those already installed.

Traditional indoor wireless communications systems transmit and receive signals through the use of a network of transmitters, receivers, and antennas that are placed throughout the interior of the building. These devices must be located in the interior structure such that the signals are not lost or the signal strength does not diminish to the point that the data being transmitted is unreliable. The placement of the devices becomes more complex when portable receivers, such as laptop computers, are integrated into the communications system.

Due to the variations in architecture and types of building materials used in different structures, the placement of transmitters, receivers, and antennas is very difficult. Wall board, steel studs, metallic air ducts, electrical conduit, plumbing, etc. all have an effect on wave propagation in a structure. Methods to determine optimal placement of communications system components to account for wave reflection and absorption include ray tracing, which uses geometrical optics and diffraction to model the propagation of waves through a structure. Statistical channel modeling, which attempts to characterize the general indoor channel by determining the most appropriate distributions for a set of channel parameters, can also be used. Despite these methods, the placement of communication systems transmitters, receivers, and antennas is still largely a process of trial and error.

Many communication systems are thus implemented inefficiently. High power or redundant transmitters are often positioned to ensure full coverage of the structure. Furthermore, a change in position of objects such as metal desks, metal filing cabinets, etc. that are placed in a room can affect the transmission or reception in that room.

Thus, there is a need for a method and a system for efficiently transmitting electromagnetic radiation signals such as RF waves, microwaves, and infrared radiation indoors without having to install an extensive system of wires and cables in the building. Also, there is a need for a method and a system for efficiently transmitting electromagnetic radiation signals indoors without having to design an elaborate system of transmitters, receivers, and antennas that may not have optimal placement.

SUMMARY OF THE INVENTION

The present invention is directed to a system for using the ductwork of a building for transmitting electromagnetic radiation. The system includes a device for introducing electromagnetic radiation into the ductwork such that the ductwork acts as a waveguide for the electromagnetic radiation. The system also includes a bi-directional coupler positioned to re-radiate the electromagnetic radiation around an obstacle. The system further includes a device for enabling the electromagnetic radiation to propagate beyond the ductwork.

The present invention represents a substantial advance over prior systems and methods for indoor transmission of communication signals. Because the present invention utilizes the structure's heating, ventilation, and air conditioning ducts, the present invention has the advantage that it is relatively inexpensive to implement. The present invention also has the advantage that it does not require the extensive use of wires or cables to transmit the communication signals. The present invention has the further advantage that it does not require complex and expensive mathematical analyses of the indoor structure to efficiently transmit the communication signals. These advantages, and other advantages and benefits of the present invention, will become apparent from the Detailed Description of the Preferred Embodiments hereinbelow.

BRIEF DESCRIPTION OF THE DRAWINGS

For the present invention to be clearly understood and readily practiced, the present invention will be described in conjunction with the following figures, wherein.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for purposes of clarity, many other elements found in typical HVAC systems and in typical wireless communication systems. Those of ordinary skill in the art will recognize that other elements are desirable and/or required to implement an HVAC system and a wireless communication system incorporating the present invention. However, because such elements are well known in the art, and because they do not facilitate a better understanding of the present invention, a discussion of such elements is not provided herein.

Figure 1:
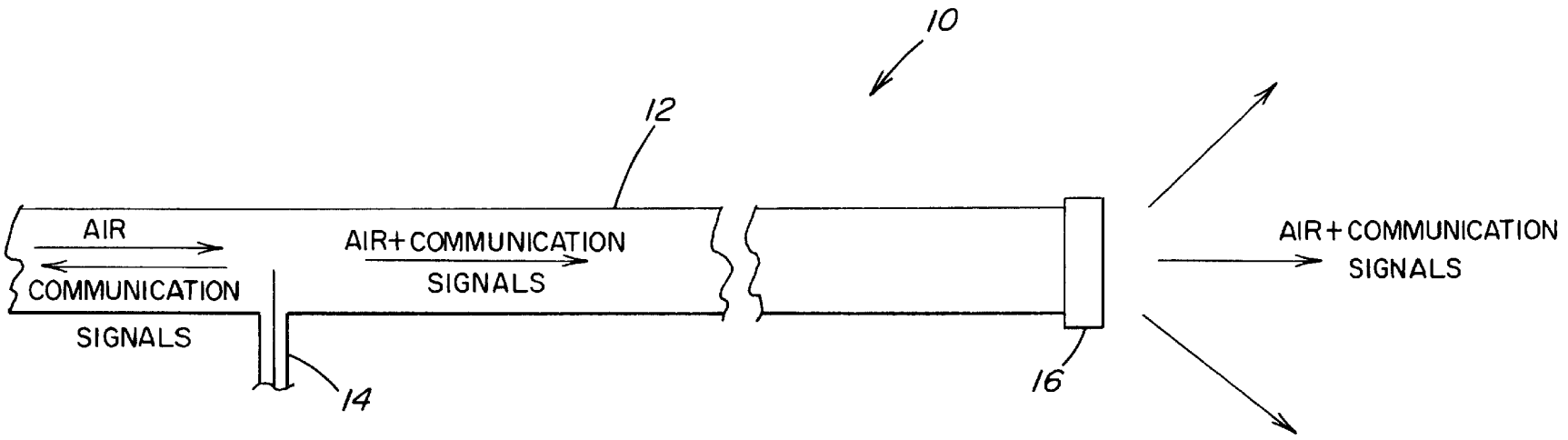
FIG. 1 is a diagram illustrating a preferred embodiment of a wireless HVAC duct transmission system.

FIG. 1 illustrates a portion of a wireless heating, ventilation, and air conditioning (HVAC) duct transmission system 10. Communication signals and air are transmitted through an HVAC duct 12, which acts as a waveguide for the communication signals. The duct 12 exhibits those properties that are common to waveguides. The properties are detailed in R. Collin, "Field Theory of Guided Waves", 2d ed., IEEE, Press, N.Y. 1991, which is incorporated herein by reference. The system 10 can utilize any HVAC duct of any shape commonly used in structures, including, for example, cylindrical HVAC ducts and rectangular HVAC ducts. The HVAC duct 12 can also be constructed of any type of electrically opaque material, such as, for example, sheet metal or foil-lined insulation.

A transmitter 14 is inserted into the HVAC duct 12. The transmitter 14 transmits communication signals through the HVAC duct 12. In the preferred embodiment shown in FIG. 1, the transmitter 14 is a coaxial to waveguide probe with its inner conductor extending into the duct 12. However, it can be understood by those skilled in the art that the transmitter 14 can be any type of electromagnetic radiation transmitter capable of transmitting in a waveguide such as, for example, an end-fed probe antenna, an end-fed loop antenna, or a transmission line fed waveguide probe antenna. A coaxial cable (not shown) is attached to the transmitter 14 to supply the transmitter 14 with the communication signals that are to be transmitted through the HVAC duct 12. The transmitter 14 can be located at a central point in the HVAC duct system of which the HVAC duct 12 is a part of. For instance, HVAC duct systems often branch out from a larger central duct. The transmitter 14 could be located in the larger central duct so that the communication signals are distributed throughout the entire HVAC duct system. The transmitter 14 could also be located at any point in the HVAC duct system that is necessary or that is readily accessible.

Because the impedance of the transmitter in the duct 12 is different from that in free space, impedance matching must be performed analytically or empirically to determine the transmission characteristics of the transmitter 14. Small sections of HVAC ducts typically have waveguide cutoff frequencies below the 900 MHz ISM band, and most HVAC ducts typically have waveguide cutoff frequencies below the 2.4 GHz ISM band. It can be understood by those skilled in the art that either analytical or empirical determinations can be used to ascertain not only the transmission characteristics of the transmitter 14, but also the necessity and location of any amplifiers or re-radiators in the duct 12.

Typical HVAC duct vents, which usually incorporate metal louvers, would block the dispersion of the communication signals outside of the HVAC duct 12. Thus, an electrically translucent grill 16 can be located at a terminus of the HVAC duct 12. The terminus of the HVAC duct 12 is positioned at a point where air from the HVAC duct 12 must diffuse into an area of the structure. The grill 16 can be constructed of any type of material that is electrically translucent and allows air to diffuse. For example, the grill 16 can be constructed of plastic. Those of ordinary skill in the art will recognize that the grill 16 can be, for example, a louver or a mesh-type grill, depending on the desired application. Also, the grill 16 can be a louver with embedded metal elements that act as re-radiating structures or passive antennas, that would cover the area of the structure in specific radiating patterns.

Figure 2:
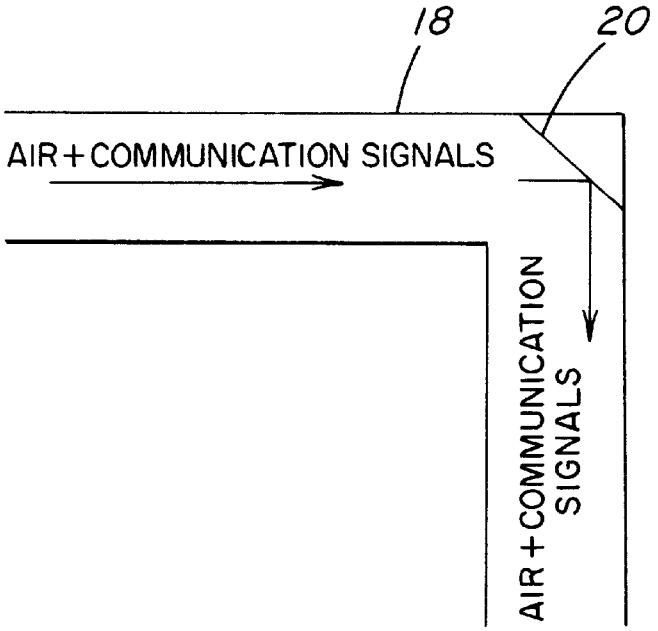
FIG. 2 is a diagram illustrating an electrically opaque reflector sheet located in a portion of an HVAC duct.

FIG. 2 illustrates a portion of an HVAC duct 18 with an electrically opaque reflector sheet 20 located at a point where the duct 18 changes direction. The sheet minimizes reflection of the communication signals due to the change in direction of the duct 18. It can be understood by those skilled in the art that the sheet 20 can be located anywhere in the duct 18 where there is a change in direction of the duct 18. For example, the sheet 20 could be located at a branch point in the duct 18 or at a turn in the duct 18. The sheet 20 reflects the communication signals in a direction which follows the direction of the duct 18. The sheet 20 does not interfere with the flow of air in the duct 18 because the flow will be deflected in the direction of the duct 18. If the change in direction of the duct 18 were a branch point, the branch point would function as a power splitter. An iris constructed of, for example, wire screen, could be inserted at the branch to ensure the desired power division at the branch.

Figure 3:
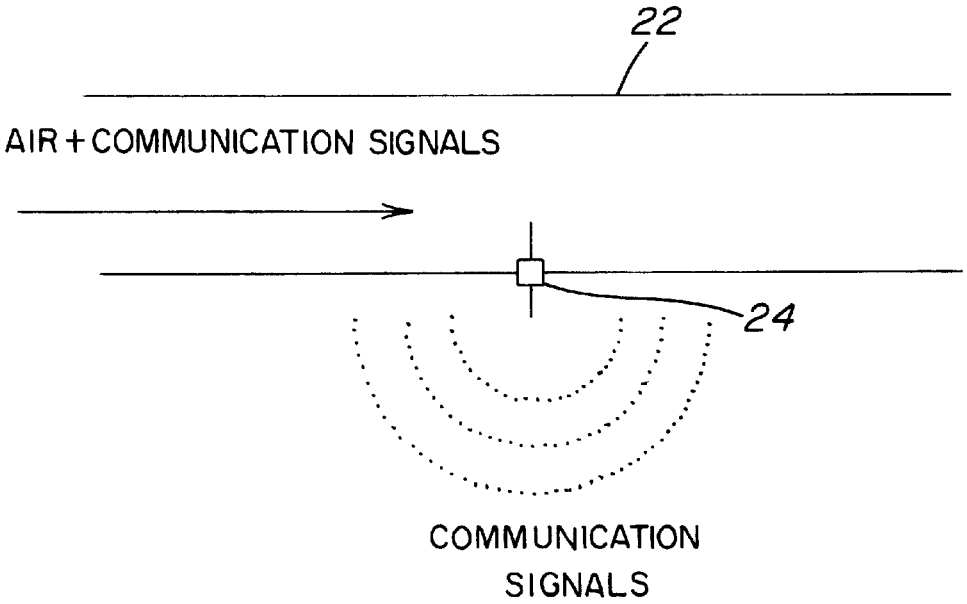
FIG. 3 is a diagram illustrating a passive re-radiator located in a portion of an HVAC duct to radiate a communication signal.

FIG. 3 illustrates a portion of an HVAC duct 22 in which a receiver 24 is located. The receiver 24 receives the communication signals and scatters them to points outside the duct when a vent is not present. The receiver 24 can be any type of signal receiver, such as, for example, a passive re-radiator, an antenna, or a coupler probe which couples the communication signals to a coaxial cable or a wire. In the preferred embodiment illustrated in FIG. 3, the receiver 24 is a passive re-radiator. Such a passive re-radiator could be, for example, a short probe which penetrates the duct and is connected to a small external monopole which radiates the communication signals into the space beyond the duct. A receiver such as that illustrated in FIG. 3 is particularly useful to disperse the communication signals into spaces such as corridors or spaces which are shielded from vents.

Figure 4:
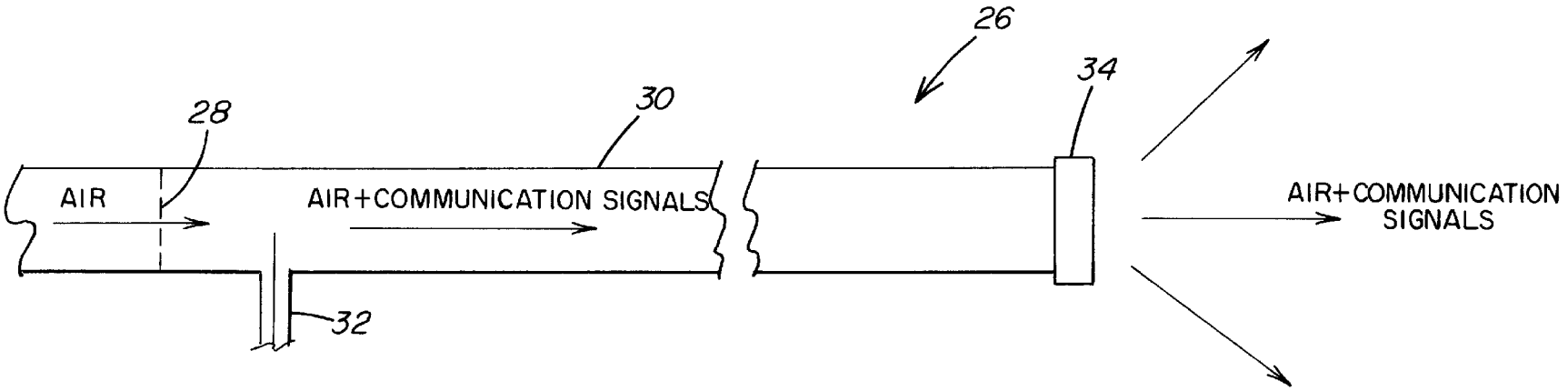
FIG. 4 is a diagram illustrating another preferred embodiment of a wireless HVAC duct transmission system with a wire screen ground plane located in the duct.

FIG. 4 is a diagram illustrating another preferred embodiment of a wireless HVAC duct transmission system 26 with a wire screen ground plane 28 located in an HVAC duct 30 adjacent to a transmitter 32. The ground plane 28 is located in a position such that it prevents the communication signals transmitted from the transmitter 32 from being transmitted to the left as shown in FIG. 4. As shown in FIG. 4, the ground plane 28 passes the air that flows through the duct 30. The air and communication signals exit the duct 30 through an electrically translucent grill 34. It can be understood by those skilled in the art that the ground plane 28 can be constructed of any type of material that is electrically opaque but can still pass air, such as, for example, a grounded wire screen. The ground plane 28 not only achieves unidirectional propagation of the communication signals, but also facilitates matching the impedance of the transmitter 32 with the impedance of the duct 30.

Figure 5:
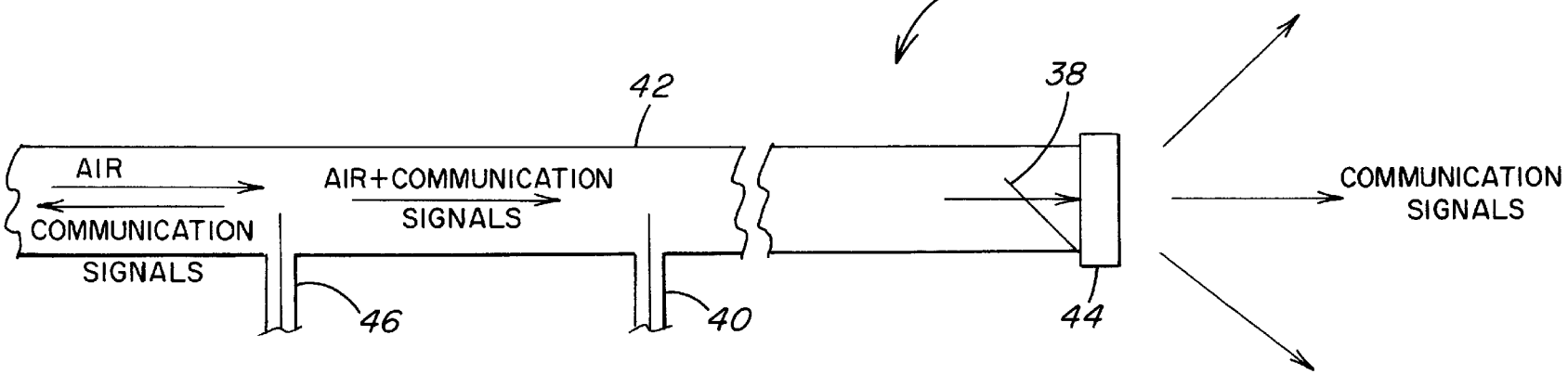
FIG. 5 is a diagram illustrating another preferred embodiment of a wireless HVAC duct transmission system with an electrically translucent damper and a coupler probe.

FIG. 5 is a diagram illustrating another preferred embodiment of a wireless HVAC duct transmission system 36 with an electrically translucent damper 38 and a coupler probe 40 located in an HVAC duct 42. A transmitter 46 transmits communication signals through the HVAC duct 42. The damper 38 is used to deflect air from exiting an electrically translucent grill 44 while permitting the communication signals to pass through the grill 44. It can be understood by those skilled in the art that the damper 38 can be constructed of any type of material that is electrically translucent but cannot pass air, such as, for example, plastic. It can also be understood by those skilled in the art that the damper 38 may be electrically opaque while allowing air to pass if the environment outside of the portion of the duct 42 which has the grill 44 is sensitive to electromagnetic radiation.

The coupler probe 40 in FIG. 5 receives the communication signals and converts the waves to an electrical signal. The electrical signal is transmitted via a coaxial cable or a wire to a point outside of the HVAC duct 42. The use of the coupler probe 40 minimizes the ambient electromagnetic radiation levels in the room to which the coaxial cable or wire from the coupler probe 40 is directed. It may be desired to eliminate the levels of electromagnetic radiation in, for example, medical and scientific environments which have equipment that may be sensitive to electromagnetic radiation. The immunity of the wireless HVAC duct transmission system 10 to interference by other devices which transmit electromagnetic radiation is also increased. Also, higher signal to noise ratios would be obtained because path loss in the space outside the duct 18 in which the electromagnetic radiation is being delivered is effectively eliminated.

It can be understood by those skilled in the art that the coupler probe 40 may be any device commonly used to couple electromagnetic radiation such as, for example, a loop of wire or a probe which is oriented in parallel with the electric field lines of the communication signals.

As illustrated in FIG. 5, one or more coupler probes 40 may be used in conjunction with one or more grills 44. However, it can be understood by those skilled in the art that an HVAC transmission system constructed according to the teachings of the present invention may incorporate grills, coupler probes, passive re-radiators, or any combination of the devices to receive the communication signals and pass them to a point outside the HVAC duct.

Figure 6:
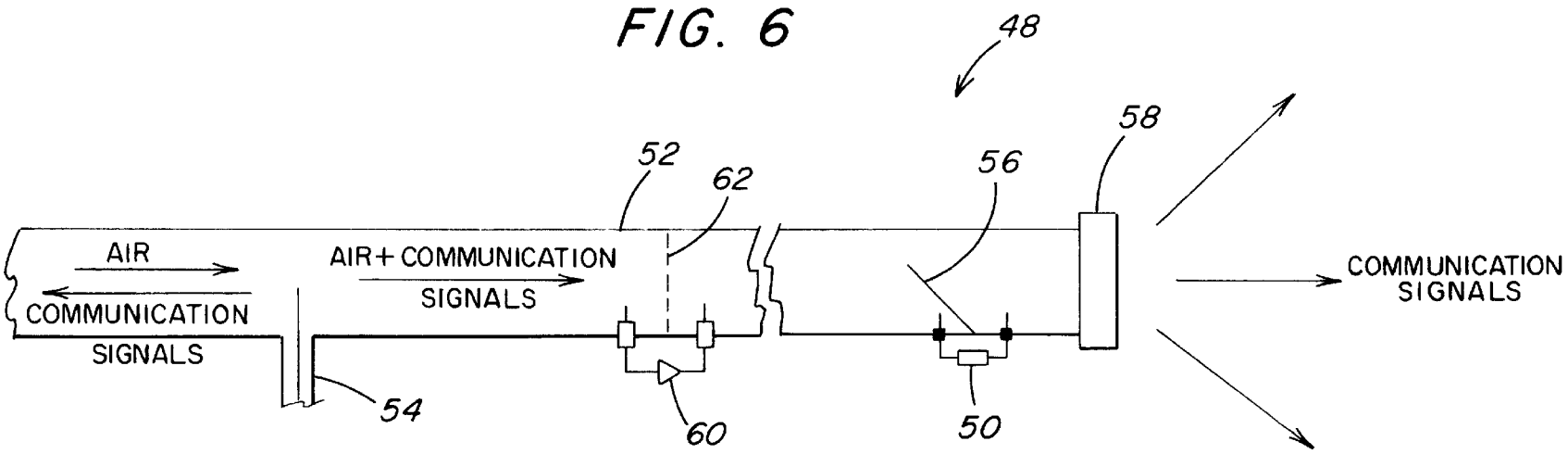
FIG. 6 is a diagram illustrating another preferred embodiment of a wireless HVAC duct transmission system with an amplified or passive re-radiator.

FIG. 6 illustrates another preferred embodiment of a wireless HVAC duct transmission system 48 with a passive or amplified re-radiator 50 located in an HVAC duct 52. A transmitter 54 transmits communication signals into the duct 52. A damper 56, which is electrically opaque, blocks the transmission of the communication signals beyond the damper 56. The re-radiator 50 receives the communication signals and re-transmits them beyond the damper 56, where they are passed to a point beyond the duct 52 by an electrically translucent grill 58. Thus, the air flow out of the duct 52 is blocked, either partially or entirely depending on the position of the damper 56, while the communication signals are diffused to a point beyond the duct 52. It can be understood by those skilled in the art that passive or amplified re-radiators 50 can be located anywhere in the duct 52 that transmission past an opaque or attenuating obstruction is necessary. Furthermore, it can be understood by those skilled in the art that passive or amplified re-radiators 50 can be used to receive communication signals from one system of HVAC ducts for retransmission into another HVAC duct system which does not have a direct mechanical connection with the first HVAC duct system.

A booster amplifier 60 is located in the duct 52 to receive, amplify, and re-radiate the communication signals in the duct 52. The booster 60 can be used if the duct 52 has a high attenuation level and the communication signals must be retransmitted at a higher signal level. A screen 62 is also positioned in the duct 52. The screen 62 is constructed such that air can pass through the screen 62. For example, the screen 62 can be a wire screen having a directional receiving coupler on one side and a directional transmitting coupler on the other side.

Figure 7:
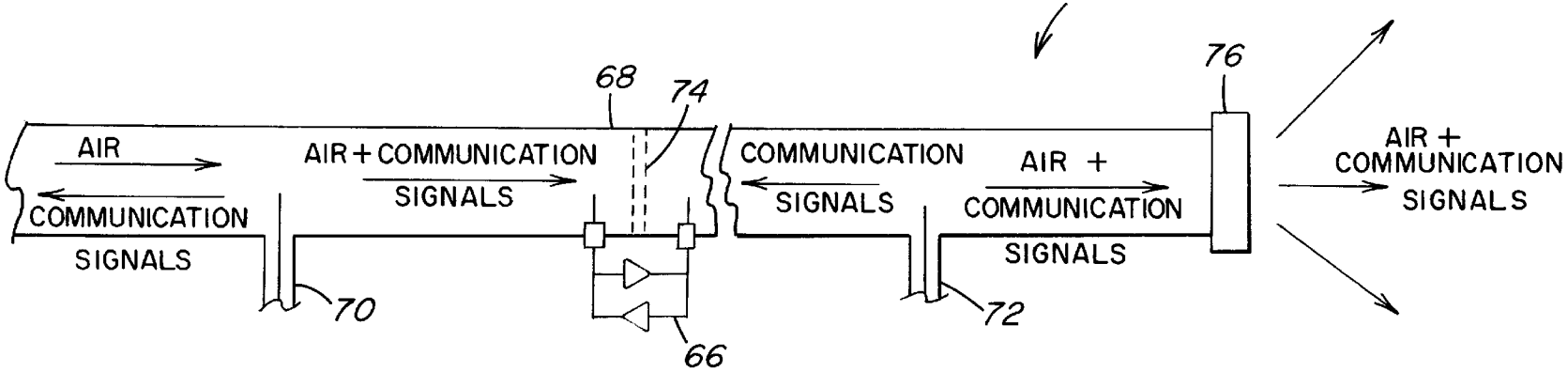
FIG. 7 is a diagram illustrating another preferred embodiment of a wireless HVAC duct transmission system with a bi-directional coupler.

FIG. 7 illustrates another preferred embodiment of a wireless HVAC duct transmission system 64 with a bi-directional coupler 66 located in an HVAC duct 68. A first transmitter 70 and a second transmitter 72 transmit communication signals into the duct 68. An obstruction 74 such as a cooling coil or a fan, blocks the transmission of the communication signals. The coupler 66 receives, amplifies, and re-radiates the communication signals beyond the obstruction 74. Because the coupler 66 is bi-directional, it can re-transmit the communication signals either in the direction of an electrically translucent grill 76 or in the direction of the first transmitter 70. The coupler 66 can be, for example, a bi-directional amplifier. The coupler 66 can also be a device that can re-radiate the communication signals in more than two directions. Such a device could be used to re-radiate the communication signals at a junction of ductwork. It can be understood by those skilled in the art that communication signals can be introduced into the duct 68 through the grill 76 instead of through the transmitters 70 and 72 to provide bi-directional transmission of the communication signals.

Figure 8:
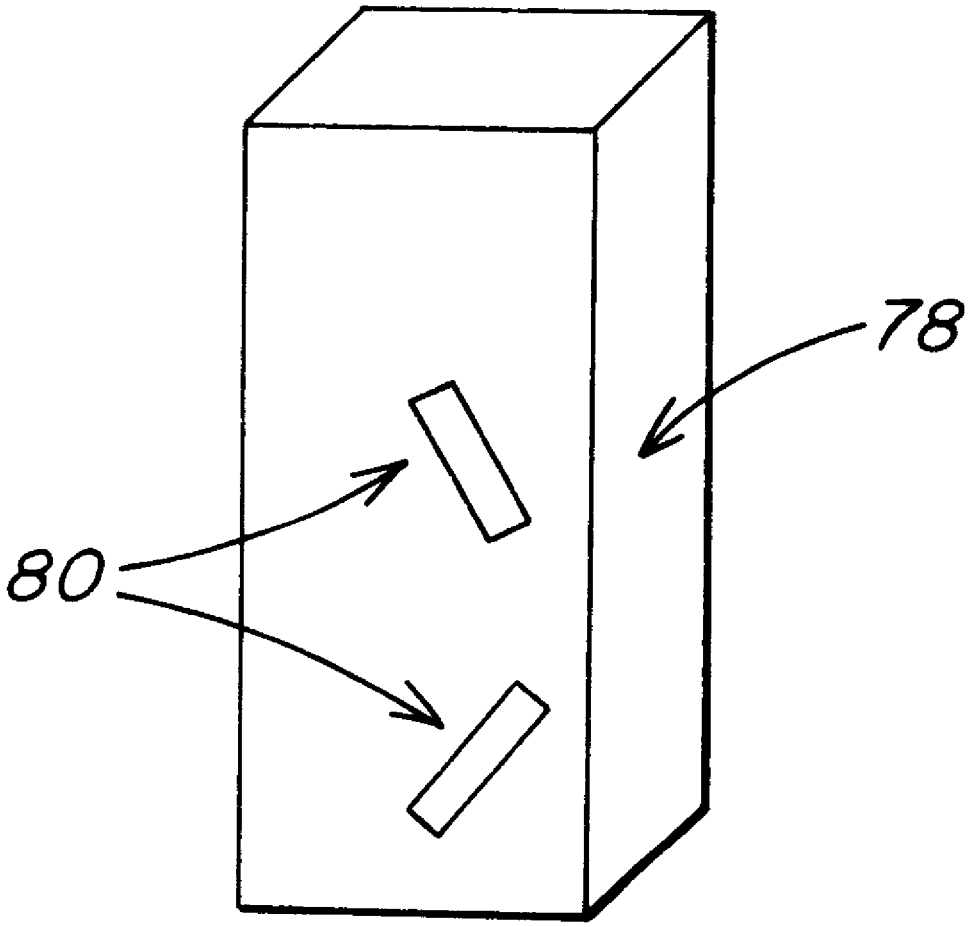
FIG. 8 is a diagram illustrating an HVAC duct with dielectric-filled slots for passively re-radiating communication signals from the duct.

FIG. 8 illustrates an HVAC duct 78 with dielectric-filled slots 80 for passively re-radiating communication signals from the duct 78. The slots 80 can be filled with any type of dielectric that is electrically transparent and prevents air flow from the duct 78 such as, for example, plastic. Radiation of communication signals from the slots 80 can be controlled by the size, shape and orientation of the slots 80 using techniques similar to those used with waveguide slot antennas. Such techniques are described in E. Wolff, "Antenna Analysis," Artech House, 1988, which is incorporated herein by reference.

The present invention also contemplates a method for transmitting electromagnetic radiation using the ductwork of a building. The method includes the steps of introducing the electromagnetic radiation into the ductwork such that the ductwork acts as a waveguide for the electromagnetic radiation and enabling the electromagnetic radiation to exit the ductwork.

The present invention further contemplates a method for designing a system for transmitting electromagnetic radiation in the ductwork of a building. The location of at least one electromagnetic radiation transmitter in the ductwork is determined. The impedance of the transmitter must be matched to the impedance of the ductwork in order for the ductwork to function properly as a waveguide. The location of at least one point where the electromagnetic radiation is to exit the ductwork is determined. The point of exit could be, for example, a grill or a re-radiator. The location of other components such as, for example, ground planes, re-radiators, and deflectors is determined. It can be understood by those skilled in the art that the method may be performed manually or may be performed automatically by, for example, software resident on the storage medium of a computer, by an application specific integrated circuit (ASIC) or using a commercially available computer aided design/computer aided engineering (CAD/CAE) program.

While the present invention has been described in conjunction with preferred embodiments thereof, many modifications and variations will be apparent to those of ordinary skill in the art. For example, absorbers could be placed inside the HVAC ducts to minimize multiple reflections of the communications signals. Such absorbers could be constructed of, for example, foam. Also, although the present invention has been described in conjunction with electromagnetic radiation communication signals, it can be understood by those skilled in the art that the present invention could be used to transmit many types of electromagnetic radiation such as, for example, RF waves and microwaves in many types of applications, including but not limited to communication systems. The foregoing description and the following claims are intended to cover all such modifications and variations.

What is claimed is:

1. A system for using the ductwork of a building for transmitting electromagnetic radiation, comprising:

a device for introducing electromagnetic radiation into the ductwork such that the ductwork acts as a waveguide for the electromagnetic radiation;

a bi-directional coupler positioned to re-radiate the electromagnetic radiation around an obstacle in the ductwork; and a device for enabling the electromagnetic radiation to propagate beyond the ductwork.

2. The system of claim 1 wherein said device for introducing includes a coaxial to waveguide probe.

3. The system of claim 1 wherein said device for introducing includes an antenna.

4. The system of claim 1 wherein said device for enabling includes a coupler probe.

5. The system of claim 1 wherein said device for enabling includes an electrically transparent louver.

6. The system of claim 1 wherein said bi-directional coupler includes a bi-directional amplifier.

7. The system of claim 1 further comprising an electrically opaque reflector located at a point in the ductwork where the ductwork changes direction, said reflector for reflecting the electromagnetic radiation in a direction following the direction of the ductwork.

8. The system of claim 7 wherein said reflector is a metal sheet.

9. The system of claim 7 wherein said reflector is a wire grid.

10. The system of claim 1 further comprising a wire screen ground plane located in the ductwork adjacent to said device for introducing.

11. The system of claim 1 further comprising an electrically translucent damper located in the ductwork, said damper for deflecting air flow in the ductwork.

12. The system of claim 1 further comprising an absorber located in the ductwork, said absorber for minimizing multiple reflections of said electromagnetic radiation.

13. The system of claim 1 wherein said device for enabling includes at least one dielectric member, said member located in a slot in the ductwork.

14. A system for distributing electromagnetic radiation through a building, comprising:

at least one HVAC duct;

means for introducing the electromagnetic radiation into said duct such that said duct acts as a waveguide for the electromagnetic radiation;

bi-directional coupler means for re-radiating the electromagnetic radiation around an obstacle in said duct; and means for enabling the electromagnetic radiation to exit said duct.

15. A method for transmitting electromagnetic radiation using the ductwork of a building, comprising the steps of:

introducing the electromagnetic radiation into the ductwork such that the ductwork acts as a waveguide for the electromagnetic radiation;

re-radiating the electromagnetic radiation in a plurality of directions around an obstacle in the ductwork; and enabling the electromagnetic radiation to exit the ductwork.

16. The method of claim 15 further comprising the step of reflecting the electromagnetic radiation in a direction following a change in direction of the ductwork.

17. The method of claim 15 further comprising the step of grounding portions of the ductwork to impede the transmission of the electromagnetic radiation.

18. The method of claim 15 further comprising the step of matching the impedance of the ductwork to the impedance of an electromagnetic radiation transmitter used for said introducing step.

19. A system for transmitting electromagnetic radiation in a heating, ventilation, and air conditioning duct, comprising:

a transmitter located in the duct, said transmitter for transmitting the radiation;

a bi-directional amplifier located in the duct, said amplifier for re-radiating the electromagnetic radiation around an obstacle in the duct; and a receiver located in the duct, said receiver for receiving the radiation.

20. The method of claim 19 further comprising a second transmitter located in the duct, said second transmitter for transmitting the radiation.

21. A method for transmitting electromagnetic radiation in a heating, ventilation, and air conditioning duct, comprising the steps of:

transmitting the electromagnetic radiation in the duct; and passing the electromagnetic radiation outside of the duct through slots in the duct filled with a dielectric material.

22. A system for transmitting electromagnetic radiation in a heating, ventilation, and air conditioning duct, comprising:

a transmitter located in the duct, said transmitter for transmitting the electromagnetic radiation; and at least one dielectric member covering a slot in the duct, said member for transmitting the electromagnetic radiation outside of the duct.

* * * * *